United States Patent [19]

Meislik

[11] 4,198,172

[45] Apr. 15, 1980

[54] ANGLED BALL TIP FOR VISCOUS FLUIDS

[75] Inventor: Ira P. Meislik, Montclair, N.J.

[73] Assignee: Tri-Chem de Puerto Rico, Inc., Vega Baja, P.R.

[21] Appl. No.: 898,303

[22] Filed: Apr. 20, 1978

[51] Int. Cl.[2] ..... B43K 7/10

[52] U.S. Cl. ..... 401/214; 401/216; 401/147

[58] Field of Search ..... 401/6–8, 401/214–216

[56] References Cited

U.S. PATENT DOCUMENTS

| | | | |
|---|---|---|---|
| 1,514,519 | 11/1924 | Harris | 401/216 |
| 2,487,340 | 11/1949 | Kleinsmith | 401/216 |
| 2,511,561 | 6/1950 | Beumer | 401/214 |
| 2,592,406 | 4/1952 | Faltin | 401/216 |
| 2,930,062 | 3/1960 | Reimann | 401/214 |
| 3,192,904 | 7/1965 | Johmann | 401/103 |
| 3,281,933 | 11/1966 | Fehling | 29/520 |
| 3,554,660 | 1/1971 | Woods | 401/214 |
| 3,819,285 | 6/1974 | Andrews et al. | 401/214 |

FOREIGN PATENT DOCUMENTS

| | | | |
|---|---|---|---|
| 902352 | 1/1954 | Fed. Rep. of Germany | 401/214 |
| 950038 | 3/1949 | France | 401/214 |
| 259852 | 2/1949 | Switzerland | 401/216 |
| 21747 | of 1891 | United Kingdom | 401/214 |

*Primary Examiner*—Clyde I. Coughenour
*Attorney, Agent, or Firm*—Omri M. Behr

[57] ABSTRACT

An angled ball tip for viscous fluid applicators which is adapted to be used with a hand-held reservoir for applying paints and other viscous fluids to cloth, wood, and the like, including a hollow housing and a spring-loaded ball disposed within said hollow housing. Pressure placed on the ball when coming into contact with a cooperating surface causes the ball to recede allowing the viscous fluid to flow around the surface of the ball and deposit on the surface.

7 Claims, 3 Drawing Figures

ANGLED BALL TIP FOR VISCOUS FLUIDS

BACKGROUND OF THE INVENTION

This invention relates to fluid applicator devices and, in particular, to a fluid applicator device for use with viscous fluids which is provided with an angled ball tip enabling the applicator to be held at an angle of 45° with the contact surface.

Fluid applicator devices having reservoirs and capable of being held in the hand have been used for making decorative surfaces and in particular applicators using ball point tips, felt marker tips and other types of applicator tips have been utilized in conjunction with flexible and rigid fluid reservoirs which reservoirs also serve as a grip or handle. The use of such applicators generally requires that the applicator be held in an upright or vertical position to the surface onto which the paint or viscous fluid is to be dispensed. Since the applicator tip is required to be positioned upright or vertical when placed against the surface to be coated, it is difficult for the user thereof to maintain the applicator in this position for any length of time.

In conventional ball point pens, it is not necessary to have the ball spring-loaded as the fluids used with them are substantially non-viscous. In order to dispense liquids through a ball tip where the liquids are viscous, a different mechanical configuration is required to mount the ball. The present configurations used for non-viscous fluids are inoperative when used with viscous liquids. The present invention overcomes the shortcomings of the prior art by allowing the ball to be pressed back into its housing when the applicator is in use, thus allowing the liquid to flow around the ball. Releasing the applicator from the surface permits the surface permits the ball to spring forward thus closing off the flow of the viscous liquid. Moreover, the present invention discloses an apparatus for utilizing a freely rotatable ball which is spring loaded and permits the applicator to be used at an angle between 30° and 50° from the surface upon which the viscous field is to be applied.

The closest prior art of which I am aware is the patent to Wood, U.S. Pat. No. 3,554,660, issued on Jan. 12, 1971. The Wood patent attempts to overcome the problem of operation at angles other than 90° by providing a connector tip which has two major connecting components which may rotate relative to each other as much as 360°. Thus, the reservoir may be rotated with respect to the actual writing tip as desired by the user thereof. This approach, although accomplishing the object of maintaining the reservoir at an angle other than 90° to the writing surface, requires a multitude of components and is expensive to fabricate.

The patent to Faltin, U.S. Pat. No. 2,592,406, issued Apr. 8, 1952, relates to the use of a ball point in conjunction with a rigid reservoir such as found in a fountain pen of the conventional ball point type. This disclosure uses a swaging process whereby the freely rotatable ball is retained in its seat for operation. Although the patent to Faltin is angularly positioned with respect to the longitudinal axis of the point, the ball is not spring-loaded and is unable to be used with viscous liquids.

The present invention overcomes all the shortcomings found in the prior art and provides a springloaded ball point tip usable with viscous liquids and permits the applicator to be held at an angle of between 30° and 50° to the surface on which the viscous liquid is to be dispensed.

SUMMARY OF THE INVENTION

An angled ball tip for viscous fluid applicators having a fluid reservoir, according to the principles of the present invention, comprises an elongated hollow housing adapted to cooperate with the fluid reservoir at one end thereof for permitting the fluid to communicate therebetween. The housing is provided with spring seats inwardly extending into the hollow, priximate one end thereof. The housing is also provided with an aperture angularly displaced from the longitudinal axis thereof at the other end. The housing is further provided with a wedge or protruding portion extending into the hollow. Further included is a ball disposed in the housing hollow at the other end which is freely rotatable and larger than the angularly displaced aperture. A spring means disposed within the housing hollow is operatively communicating with the spring seats and the ball for urging the ball into simultaneous contact with the wedge portion and the angularly disposed aperture whereby the viscous fluid is capable of flowing from the reservoir through the hollow and the aperture upon pressure contact between the ball and a cooperating surface.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
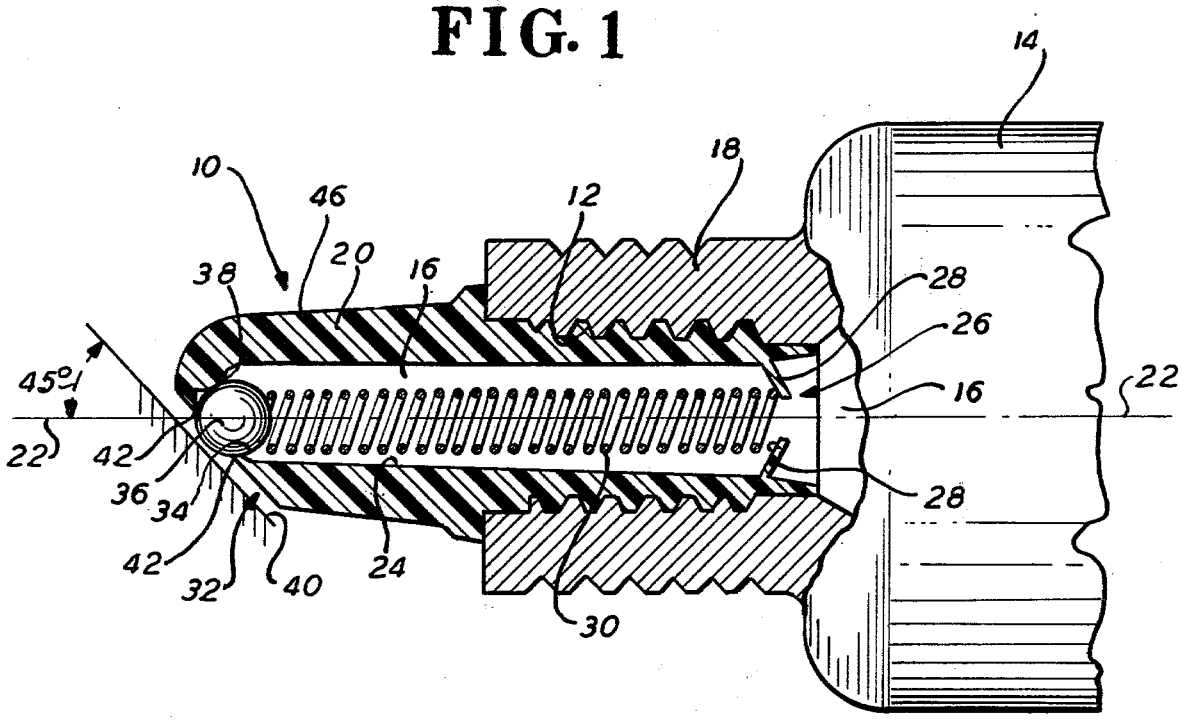
FIG. 1 is an enlarged view, partially in cross-section, of an angled ball tip, according to the principle of the present invention, inserted into a malleable tube or reservoir.

Referring now to the drawings, and in particular to FIG. 1, an angled ball tip 10 shown in cross-section and inserted in an internally threaded orifice 12 of a viscous liquid reservoir 14, which may be a tube made from thin aluminum or any other easily bendable material to permit the user to squeeze the tube to expel the viscous fluid such as paint 16 contained therein. The outer portion or neck 18 to which the threaded orifice 12 is provided is externally threaded and is adapted to receive a paint cap, now shown, to seal the reservoir when not in use. Preferably, the angled ball tip 10 includes a housing 20 fabricated from a plastic material. The housing 20 is elongated and has a longitudinal axis 22 which runs the length of a centrally disposed opening 24. At one end 26 of the housing 20, spring seats 28 are provided after the spring has been inserted into opening 24. The spring seats 28 extend inwardly into said opening or hollow 24 in the housing 20 and function as a retainer for a coil spring 30.

At the other end 32 of the housing 20 an angularly displaced aperture 34 is provided. The plane of the angularly displaced aperture 34 preferably forms an angle of 45° with the longitudinal axis 22. A ball 36 is placed within the hollow opening 24 and the end 32 of housing 20. Spring 30 urges the ball 36 against the angular aperture 34 and a wedge portion 38 formed opposite said angularly disposed aperture 34 and proximate thereto. The wedge portion 38 is designed to transfer any forces which appear on ball 36 when coming into contact with a surface 40 to a force along the longitudinal axis 22, thereby permitting the ball 36 to recede further into the opening 24 and permitting the ink 16 to flow from the reservoir 14 through the opening 24, around the freely rotatable ball, out through aperture 34 and be deposited upon the surface 40. The angularly displaced aperture 34 is additionally provided with an angular internally disposed protrusion 42 forming a seat for freely rotating ball 36.

The external surface of housing 20 at the aperture end, is cut at an angle which is parallel with the plane of the angularly displaced aperture 34 permitting the applicator to be held at an angle of 45°, preferably, when depositing viscous fluid on the surface 40.

Figure 3:
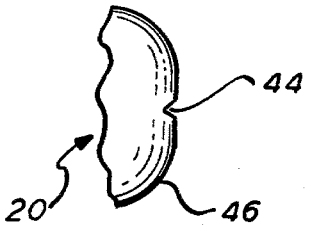
FIG. 3 is an end view in elevation taken along the line 3—3 of FIG. 2.
Figure 2:
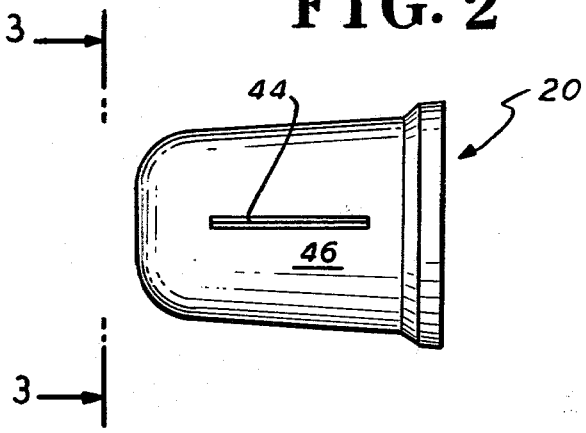
FIG. 2 is a top or plan view showing the location of the positioning means.

FIGS. 2 and 3 show the location of a recess 44 which is wedge-shaped and disposed opposite aperture 34 on the external surface 46 of the angled ball tip 10. Thus, a person using the applicator is able to position the ball directly above a particular area onto which the viscous liquid is to be dispersed.

In operation, the cat, not shown, of the reservoir 14 is removed and the elongated ball tip is threaded into the orifice 12 of the neck 18 provided on the reservoir 14. The reservoir 14 is pressed by hand to provide a continuing pressure forcing the viscous liquid 16 through the hollow opening 24 to the ball 36. Since the ball 36 is urged against the aperture 34, the viscous fluid 16 is unable to leave the aperture. When the ball 36 is pressed against a cooperating surface 40 it is permitted to recess into opening 24, thereby permitting the viscous fluid 16 to flow around the ball 36 as it is rotated over the surface.

Hereinbefore, has been disclosed an angled ball tip usable for viscous fluid applicators, such as paint, which is inexpensive to manufacture, has a minimum number of components and allows the applicator to be held at an angle of 45° with respect to the surface onto which the viscous liquid is to be dispensed. It will be understood that various changes in the details, materials, arrangements of the parts and operating conditions which have been herein described and illustrated in order to explain the nature of the invention may be made by those skilled in the art within the principles and scope of the present invention.

Having thus set forth the nature of the invention what is claimed is:

1. An angled ball tip for viscous fluid applicators having a fluid reservoir comprising:

A. an elongated hollow housing adapted to cooperate with said fluid reservoir at one end thereof for permitting said fluid to communicate therebetween, (i) said housing being provided with spring seats inwardly extending into said hollow proximate said one end thereof, (ii) said housing being provided with an aperture angularly displaced from the longitudinal axis thereof at the other end, (iii) said housing further including an integral wedge portion extending into said hollow proximate said aperture;

B. a ball disposed within said housing hollow at said other end, said ball being freely rotatable and recedable into said hollow housing, and larger than said angularly displaced aperture; and C. spring means disposed along said longitudinal axis and within said housing hollow, operatively cooperating with said spring seats and in intimate contact with said ball for urging said ball into simultaneous contact with said wedge portion and said angularly disposed aperture said spring receiving pressure contact forces generated by contact with a cooperating surface via said wedge whereby said viscous fluid is capable of flowing from said reservoir through said hollow and said aperture upon pressure contact between said ball and the cooperating surface.

2. An angled ball tip for viscous fluids according to claim 1 wherein said housing further includes positioning means disposed on the external surface of said housing diametrically opposed to said aperture.

3. An angled ball tip for viscous fluids according to claim 1 wherein said housing is provided with an externally threaded portion at said one end adapted to be received by an orifice provided in said reservoir.

4. An angled ball tip for viscous fluids according to claim 1 wherein said wedge portion directs the forces occurring upon pressure contact of said ball with said surface along the longitudinal axis of said housing permitting said ball to recede into said housing for said viscous fluid to flow therearound.

5. An angled ball tip for viscous fluids according to claim 1 wherein said spring means is a coil spring.

6. An angled ball tip for viscous fluids according to claim 1 wherein the plane of said angularly displaced aperture forms an angle of between 30° and 50° with the longitudinal housing axis.

7. An angled ball tip for viscous fluids according to claim 1 wherein said reservoir is a compressable nonresilient paint tube of a suitable size to be hand held and is provided with an internally threaded exit orifice adapted to receive said angled ball tip.

* * * * *

UNITED STATES PATENT OFFICE

CERTIFICATE OF CORRECTION

Patent No. 4,198,172 Dated April 15, 1980

Inventor(s) Ira P. Meislik

It is certified that error appears in the above-identified patent and that said Letters Patent are hereby corrected as shown below:

Col. 1, line 42; delete "field" and substitute therefor --fluid--.

Col. 2, line 11, delete "priximate" and substitute therefor --proximate--.

Col. 2, line 51, delete "now" and substitute therefor --not--.

Col. 2, line 65, delete "and" and substitute therefor --at--.

Col. 3, line 23, delete "cat" and substitute therefor --cap--.

Signed and Sealed this

Third Day of February 1981

[SEAL]

Attest:

RENE D. TEGTMEYER

Attesting Officer

Acting Commissioner of Patents and Trademarks